US005423537A

United States Patent [19]

Santana

[11] Patent Number: 5,423,537

[45] Date of Patent: Jun. 13, 1995

[54] MINIATURIZED GAMES FOR SIMULATING THE PLAYING OF SOCCER

[76] Inventor: Sergio S. Santana, 8071 Wolff St., Unit C, Westminster, Colo. 80030

[21] Appl. No.: 203,297

[22] Filed: Mar. 1, 1994

[51] Int. Cl.[6] ..... A63F 7/06

[52] U.S. Cl. ..... 273/85 R; 273/126 R; 273/129 R

[58] Field of Search ..... 273/85 R–85 H, 273/108–126, 129 K, 129 L, 94, 129 R

[56] References Cited

U.S. PATENT DOCUMENTS

| | | | |
|---|---|---|---|
| 4,060,245 | 11/1977 | Duch | 273/85 R |
| 4,211,408 | 7/1980 | Tickle | 273/85 R |
| 4,257,599 | 3/1981 | Cutri | 273/85 R |
| 4,274,635 | 6/1981 | Pakogian | 273/85 R |
| 4,408,761 | 10/1983 | McAllister | 273/85 R |
| 5,074,556 | 12/1991 | Loeppky | 273/85 R |
| 5,092,595 | 3/1992 | Daravina | 273/85 R |

FOREIGN PATENT DOCUMENTS

| | | | |
|---|---|---|---|
| 150166 | 9/1920 | United Kingdom | 273/85 R |
| 634857 | 3/1950 | United Kingdom | 273/94 |
| 638476 | 6/1950 | United Kingdom | 273/85 R |
| 733424 | 7/1955 | United Kingdom | 273/85 R |

*Primary Examiner*—Sebastiano Passaniti

[57] ABSTRACT

A miniaturized game for simulating the playing of soccer comprising a game board having a generally planar upper surface and a lower surface adapted to be placed on a horizontal support whereat the game is to be played, the upper support surface being provided with an upwardly extending wall around the majority of a central extent of the game board, the wall having long parallel side edges and short end edges, each of the end edges being provided with an aperture extending therethrough and with miniaturized goals positioned to cover the apertures and facing each other, the playing surface having indicia thereon indicative of marking lines of a conventional soccer field.

1 Claim, 3 Drawing Sheets

MINIATURIZED GAMES FOR SIMULATING THE PLAYING OF SOCCER

BACKGROUND OF THE INVENTION

1. Field of the Invention

The present invention relates to miniaturized games for simulating the playing of soccer and more particularly pertains to playing a soccer game on a miniaturized board with a miniaturized ball, players and pallet.

2. Description of the Prior Art

The use of board games is known in the prior art. More specifically, board games heretofore devised and utilized for the purpose of playing games of skill and chance for recreation and entertainment and competition are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,724,851 discloses a table soccer or football game structure.

U.S. Pat. No. 3,870,303 discloses a soccer table with goal and penalty opening.

U.S. Pat. No. 4,025,073 discloses a table soccer or football game structure.

U.S. Pat. No. 5,058,892 discloses a table soccer or fuseball game playing ball.

U.S. Pat. No. 5,071,137 discloses a table soccer game bumper structure.

In this respect, the miniaturized game for simulating the playing of soccer according to the present invention substantially departs from the conventional concepts and designs of the prior art, and in doing so provides an apparatus primarily developed for the purpose of playing a soccer game on a miniaturized board with a miniaturized ball, players and pallet.

Therefore, it can be appreciated that there exists a continuing need for new and improved miniaturized game for simulating the playing of soccer which can be used for playing a soccer game on a miniaturized board with a miniaturized ball, players and pallet. In this regard, the present invention substantially fulfills this need.

SUMMARY OF THE INVENTION

In view of the foregoing disadvantages inherent in the known types of board games now present in the prior art, the present invention provides an improved miniaturized game for simulating the playing of soccer. As such, the general purpose of the present invention, which will be described subsequently in greater detail, is to provide a new and improved miniaturized game for simulating the playing of soccer and method which has all the advantages of the prior art and none of the disadvantages.

To attain this, the present invention essentially comprises a new and improved miniaturized game for simulating the playing of soccer comprising, in combination a game board having a generally planar upper surface and a lower surface adapted to be placed on a horizontal support whereat the game is to be played, the upper support surface being provided with an upwardly extending wall around the majority of a central extent of the game board, the wall having long parallel side edges and short end edges, each of the end edges being provided with an aperture extending therethrough and with miniaturized goals positioned to cover the apertures and facing each other, the playing surface having indicia thereon indicative of marking lines of a conventional soccer field; a plurality of toy players, the toy players being provided with the indicia of one of two teams, the players having a hollow lower extent with weight material therein whereby when standing upon the upper surface of the game board, the players will tend to remain erect unless struck by a force sufficient to tip over or move such players; a miniaturized ball of a spherical configuration positionable on the game board, the ball being of such size as to fit within the nets at the opposite ends of the playing surface; and a palette formed of a stick with a planar surface having a first end with a handle adapted to be held by the fingers of a user and having a second end for striking the ball in an effort to propel it into the goal at the opposite end thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved miniaturized games for simulating the playing of soccer which have all the advantages of the prior art board games and none of the disadvantages.

It is another object of the present invention to provide new and improved miniaturized games for simulating the playing of soccer which may be easily and efficiently manufactured and marketed.

It is further object of the present invention to provide new and improved miniaturized games for simulating the playing of soccer which are of durable and reliable constructions.

An even further object of the present invention is to provide new and improved miniaturized games for simulating the playing of soccer which are susceptible of a low cost of manufacture with regard to both materials and labor, and which accordingly are then susceptible of low prices of sale to the consuming public, thereby making such miniaturized game for simulating the playing of soccer economically available to the buying public.

Still yet another object of the present invention is to provide new and improved miniaturized game for simulating the playing of soccer which provide in the apparatuses and methods of the prior art some of the advantages thereof, while simultaneously overcoming some of the disadvantages normally associated therewith.

Still another object of the present invention is to play a soccer game on a miniaturized board with a miniaturized ball, players, and pallet.

Lastly, it is an object of the present invention to provide new and improved a miniaturized game for simulating the playing of soccer comprising a game board having a generally planar upper surface and a lower surface adapted to be placed on a horizontal support whereat the game is to be played, the upper support surface being provided with an upwardly extending wall around the majority of a central extent of the game board, the wall having long parallel side edges and short end edges, each of the end edges being provided with an aperture extending therethrough and with miniaturized goals positioned to cover the apertures and facing each other, the playing surface having indicia thereon indicative of marking lines of a conventional soccer field.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
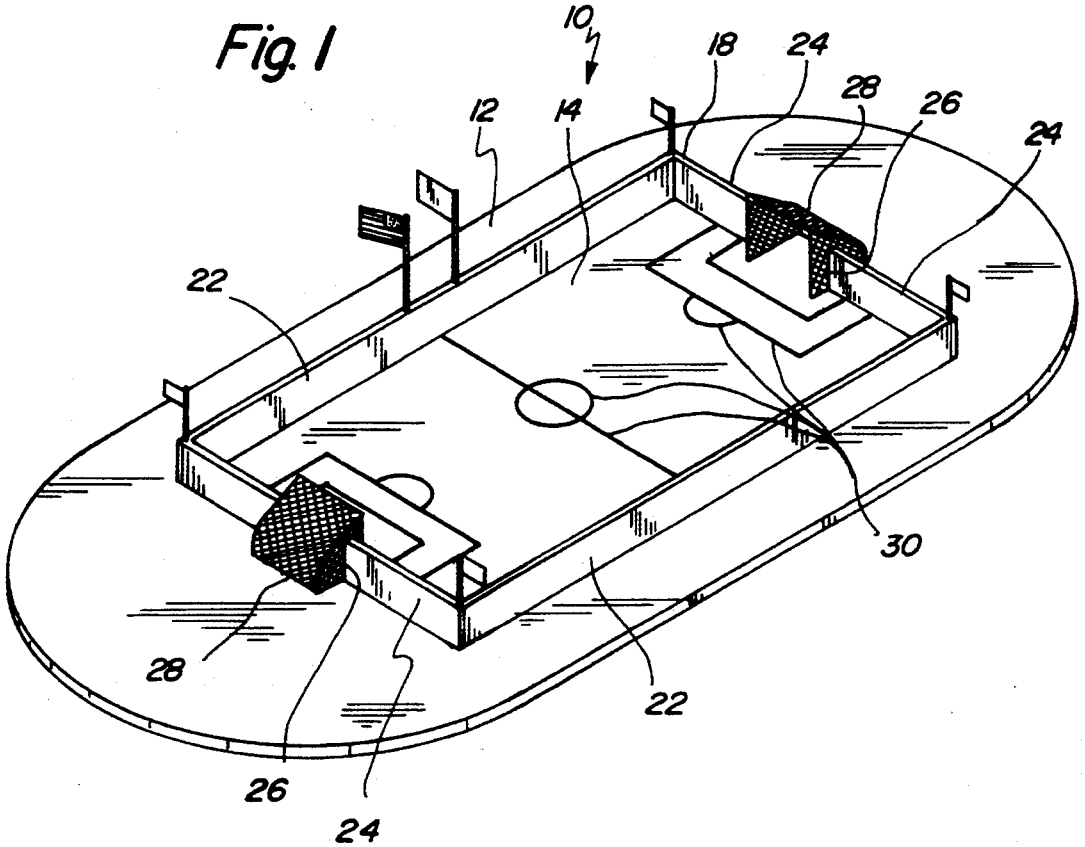
FIG. 1 is a perspective illustration of the preferred embodiment of the new and improved miniaturized game for simulating the playing of soccer constructed in accordance with the principles of the present invention.
Figure 2:
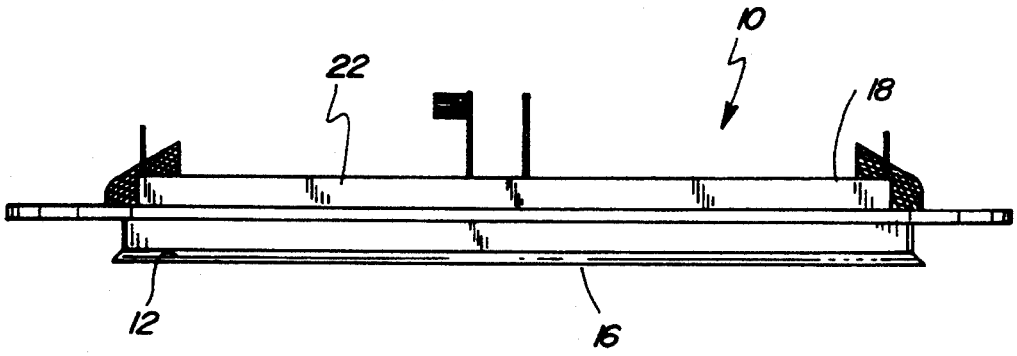
FIG. 2 is a side elevational view of the board of the game as shown in FIG. 1.
Figure 3:
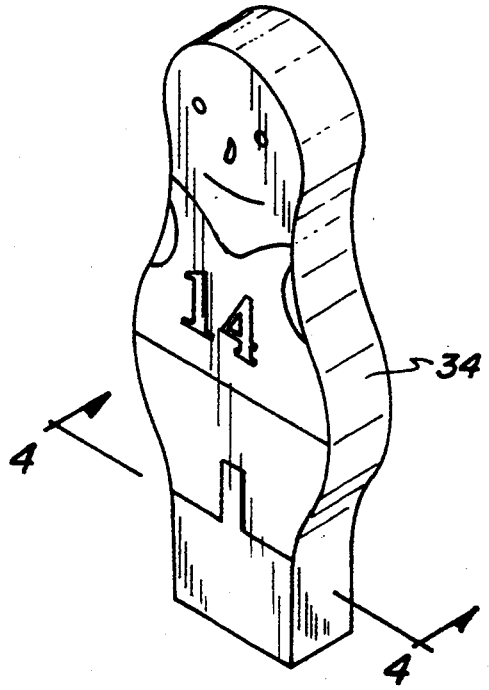
FIG. 3 is a perspective illustration of a miniaturized toy player adapted to be used in association with the board as illustrated in FIGS. 1 and 2.
Figure 4:
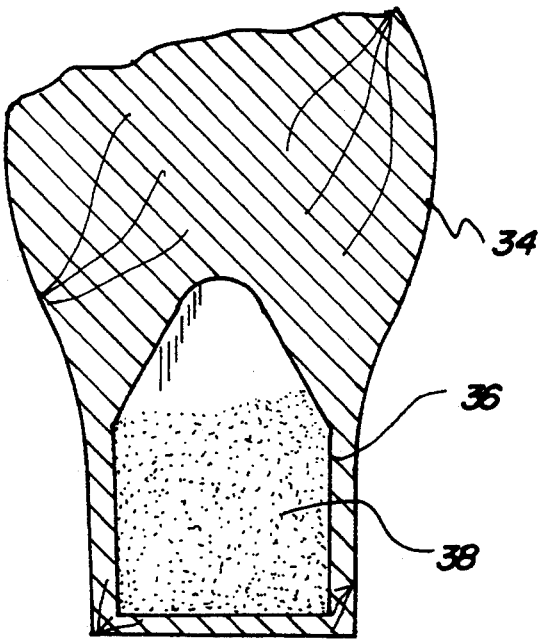
FIG. 4 is a cross-sectional view taken along lines 4—4 of FIG. 3.
Figure 5:
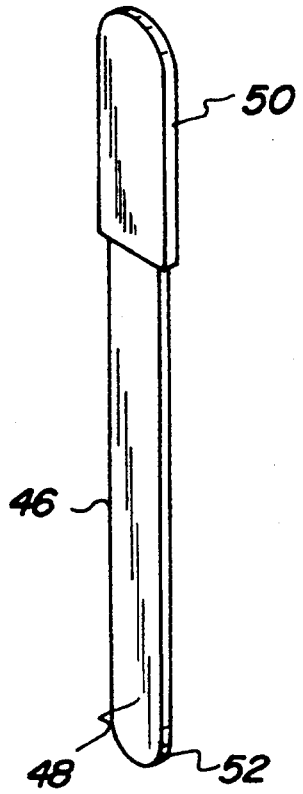
FIG. 5 is a perspective view of the palette employed for striking the ball and playing the game on the board of FIGS. 1 and 2.
Figure 6:
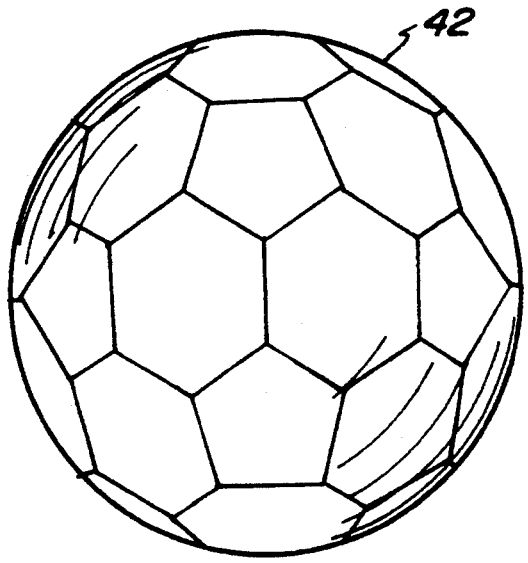
FIG. 6 is a front elevational view of a miniaturized soccer ball adapted to be used in association with playing the game with the equipment shown in the prior Figures.

With reference now to the drawings, and in particular to FIG. 1 thereof, the preferred embodiment of the new and improved miniaturized game for simulating the playing of soccer embodying the principles and concepts of the present invention and generally designated by the reference numeral 10 will be described.

The present invention, the miniaturized game for simulating the playing of soccer, is comprised of a plurality of components. The components, in their broadest context, include a game board, toy players, a miniaturized ball, and a palette. These components are specifically configured and correlated one with respect to another so as to attain their appropriate objective.

More specifically, the game 10 has as its primary component a game board 12. The game board has a generally planar upper surface 14. It also includes a lower surface 16. The lower surface is adapted to be placed on a horizontal support such as a table or the ground whereat the game is to be played. The upper surface is provided with an upwardly extending wall 18. The wall extends around the majority of the central extent of the game board. It also allows for a peripheral area between the wall and the periphery of the board.

The wall has long parallel side edges 22 and short end edges 24. Each of the end edges is provided with a central aperture 26 extending therethrough. Located at the apertures at the opposite ends are miniaturized goals 28. The goals are positioned to cover the apertures. They are located facing each other so that a ball may be moved through the aperture in the wall into one goal or the other. The playing surface is also provided with markings and other indicia 30 thereon. Such indicia is indicative of and corresponds to the marking lines of a conventional soccer field.

A plurality of players 34 are also provided. The toy players are provided with markings or color coding representing indicia of one of two teams. An equal number of players are provided. Each of the players has a hollow lower extent 36. Weight material 38 is provided in such lower extents. In this manner, the players tend to stand in an upright erect position as shown when supported and standing on the upper surface of the game board. The players, however, will tend to remain erect unless struck by a force as caused by a ball only when such force is sufficient to tip over or move such player. Such action of the ball with respect to a player correlates to the conventional motions in a standard soccer game at full size with real players.

A miniaturized ball 42 is also provided. The ball is of a conventional appearance corresponding to a conventional full size soccer ball. It is of a spherical configuration and is positionable on the game board to be moved around. The ball is of a reduced size, however, corresponding to a reduced size correlated to that of a conventional soccer field and players. The ball is of such size as to fit within the nets at the opposite ends of the playing surface.

Movement of the ball toward one goal or the other is effected by a palette 46. The palette is formed as a stick with opposed planar playing surfaces 48. The palette or stick has a first end with a handle 50. Such handle is adapted to be held by the fingers of the user. The palette or stick also has a second end 52. The second end is for striking the ball in an effort to propel it into the goal at one end or the other corresponding to the direction that one player or another must attack in order to score points.

The present invention is a game for entertainment; specifically, a mini soccer game, complete with two goal nets, 22 players, one mini soccer ball, one referee, etc.

The player controls the action game. Even though the game is designed to be played by two people, i.e. one player for each team, it can be played by more than two people.

To start the game, the mini ball must be placed at the center of the field and kicked by one person. After the first kick, players alternate turns until one team scores and then the ball is placed in the center of the field again.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved miniaturized game for simulating the playing of soccer comprising, in combination:

a game board having a generally planar upper surface and a lower surface with a periphery adapted to be placed on a horizontal support whereat the game is to be played, the upper support surface being provided with an upwardly extending wall around the majority of a central extent of the game board interiorly of the entire periphery, the wall having long parallel side edges and short end edges, each of the end edges being provided with an aperture extending therethrough and with miniaturized goals positioned to cover the apertures to extend forwardly and rearwardly of the apertures and thereabove facing each other, the playing surface having indicia thereon indicative of marking lines of a conventional soccer field;

a plurality of toy players, the toy players being provided with the indicia of one of two teams, the players having a hollow lower extent with weight material therein whereby when standing upon the upper surface of the game board, the players will tend to remain erect unless struck by a force sufficient to tip over or move such players;

a miniaturized ball of a spherical configuration positionable on the game board, the ball being of such size as to fit within the nets at the opposite ends of the playing surface; and a palette formed of a straight stick with a planar surface having a first end with a handle adapted to be held by the fingers of a user and having a second end for striking the ball in an effort to propel it into the goal at the opposite end thereof.

* * * * *